US006560495B1

(12) United States Patent
Furuta et al.

(10) Patent No.: US 6,560,495 B1
(45) Date of Patent: May 6, 2003

(54) METHOD AND DEVICE FOR LOCKING WORK MACHINE

(75) Inventors: Hideto Furuta, Tokyo (JP); Naoyuki Moriya, Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 0 days.

(21) Appl. No.: 09/513,363

(22) Filed: Feb. 25, 2000

Related U.S. Application Data

(63) Continuation of application No. PCT/JP99/02402, filed on May 10, 1999.

(30) Foreign Application Priority Data

Jun. 29, 1998 (JP) ..... 10-181984

(51) Int. Cl.[7] ..... G05B 9/02
(52) U.S. Cl. ..... 700/79; 701/50; 307/326
(58) Field of Search ..... 700/79, 81, 177; 701/50; 702/114; 307/328, 326

(56) References Cited

U.S. PATENT DOCUMENTS 3,709,101 A * 1/1973 Richterkessing ..... 91/424
3,915,273 A * 10/1975 Loschengruber ..... 192/135
4,338,115 A * 7/1982 Farkas ..... 65/29
4,489,377 A * 12/1984 Mawyer et al. ..... 364/167
4,959,647 A * 9/1990 Daigle ..... 340/825.72
5,293,024 A * 3/1994 Sugahara et al. ..... 219/121.67
5,345,138 A * 9/1994 Mukaidono et al. ..... 307/326
5,492,022 A * 2/1996 Elias ..... 73/865.7
5,880,954 A * 3/1999 Thomson et al. ..... 364/184
5,921,367 A * 7/1999 Kashioka et al. ..... 192/130
5,950,426 A * 9/1999 Morita et al. ..... 60/399
5,974,796 A * 11/1999 Ishikawa et al. ..... 60/399
5,993,039 A * 11/1999 Crill ..... 364/184

* cited by examiner

*Primary Examiner*—Paul P. Gordon
(74) *Attorney, Agent, or Firm*—Darby & Darby

(57) ABSTRACT

The detectors, which are adapted to detect operation signals from operating devices for inputting actuation commands to a work machine, and hydraulic system locking switch, which is adapted to command locking so as to halt the work machine or unlocking to enable the work machine to resume working, are connected to a logic circuit adapted to compute the method of locking the work machine based on signals input from these components. A hydraulic system locking electromagnetic selector valve adapted to maintain or release the work machine at or from the locked state is connected to the logic circuit. In case an unlocking command is sent in the situation where there is an outstanding operation signal input to the work machine, the logic circuit maintains the work machine at the locked state until a safety check is performed. By commanding unlocking of the work machine after commanding its locking in the state where there is no outstanding operation signal input to the work machine, the work machine is released from the locked state.

5 Claims, 6 Drawing Sheets

METHOD AND DEVICE FOR LOCKING WORK MACHINE

This is a continuation of International Application No. PCT/JP99/02402, filed May 10, 1999.

TECHNICAL FIELD

The present invention relates to a locking method for forcibly halting operation of a work machine and a locking device used for such a method.

BACKGROUND OF THE INVENTION

FIG. 4 shows a hydraulic shovel as a work machine. The hydraulic shovel has a lower structure 13 including a pair of crawler belts 12 that are disposed at the two lateral sides of the lower structure 13 and driven by a pair of laterally arranged travel motors 11 respectively. An upper structure 16 is attached to the lower structure 13 with a rotating portion 15 therebetween. The rotating portion 15 is so designed as to be driven by a swing motor 14. A cab 17, in which a driving seat for an operator is installed, and a front attachment 18 for performing excavation are mounted on the upper structure 16.

The front attachment 18 includes a boom 20, a stick 22 and an attachment 29, which may be a bucket 24, a breaker or the like. The boom 20 is supported by the upper structure 16 by means of a pin 19, which attaches the boom 20 to a shaft of the upper structure 16 so that the boom 20 is capable of rotating around the shaft. A pin 21 attaches the stick 22 to a shaft disposed at the end of the boom 20 so that the stick 22 is rotatably supported by the boom 20. A pin 23 attaches the attachment 29 to a shaft disposed at the end of the stick 22 so that the attachment 29 is rotatably supported by the stick 22. The boom 20 and the stick 22 are adapted to be rotated by a boom cylinder 25 and a stick cylinder 26 respectively, while the bucket 24 or the attachment 29 is adapted to be rotated by a bucket cylinder 27 and a link mechanism 28.

A work machine having a structure described above is provided with a hydraulic system locking mechanism for locking the supply of oil pressure to various hydraulic actuators, such as the laterally arranged travel motors 11, the swing motor 14, the boom cylinder 25, the stick cylinder 26 and the bucket cylinder 27.

A conventional hydraulic system locking mechanism is directly operated by turning on or off a lock operation switch. Therefore, when an operator releases the hydraulic system from the locked state, the hydraulic system is unlocked regardless of the condition of the machine. In other words, should the hydraulic system lock be released in a situation where signals have been input to one or a number of the operation levers, the work machine suddenly starts running in response to the signals input to the operation lever(s).

In case the lock of the hydraulic system is released when an operation lever is in an unusual, unexpected state, such that, for example, a part of the clothes of the operator is caught by the operation lever, the work machine will move in a way the operator is not aware of. Such an event is not desirable. One of the worst possible cases will be a situation where a worker is near the work machine while signals to command swinging have been input to the operation levers. In such a case, it is absolutely imperative to prevent releasing of the lock of the hydraulic system.

As described above, a work machine equipped with an electronically controlled hydraulic system that functions according to a conventional method is not always safe, because, depending on an outstanding command input to the corresponding operation lever, releasing the lock of the hydraulic system by the operator may undesirably actuate a hydraulic actuator.

OBJECTS AND SUMMARY OF THE INVENTION

In order to solve the above problem, an object of the present invention is to ensure the safety of a work machine by requiring the operator to check the safety before releasing the work machine from the locked state.

Once a work machine becomes locked so that its operation is forcibly halted, a work machine locking method according to the present invention maintains the work machine locked until a safety check is performed.

Therefore, once the work machine becomes locked, even if release of the lock of the work machine is commanded thereafter, the work machine is kept locked and cannot be released from the locked state regardless of whether the operator of the work machine operates the work machine. The locking continues until the operator of the work machine performs a safety check. The invention thus prevents an accident that may otherwise be caused by inadvertent actuation of the work machine due to carelessness of the operator.

Furthermore, in case unlocking of the work machine is commanded in the situation where there is an outstanding actuation command input to the work machine, the aforementioned method calls for maintaining the work machine locked until a safety check is performed.

Therefore, when the work machine is in the state where an actuation command has been input, even if the operator commands unlocking, the work machine is prevented from being actuated until a safety check is performed. The invention thus prevents an accident that may otherwise be caused by the operator's careless operation to actuate the work machine or release the lock of the work machine.

In case there is an outstanding command for unlocking of the work machine while there is no outstanding actuation command input to the work machine, the aforementioned method calls for maintaining the work machine locked.

When there is no outstanding actuation command input to the work machine, it is often impossible to judge whether the work machine is locked or unlocked. Therefore, even if there is no outstanding actuation command input to the work machine, the invention ensures complete safety by maintaining the work machine locked and calling attention of the operator when unlocking of the work machine has been commanded.

In the method described above, the work machine can be released from the locked state by commanding locking in the state where there is no outstanding actuation command input to the work machine and, thereafter, commanding release of the lock of the work machine.

According to the above method, the work machine is released from the locked state and made ready to be actuated by commanding locking so as to perform a safety check in the state where there is no outstanding actuation command input to the work machine and, thereafter, commanding release of the lock of the work machine. Thus, the invention facilitates a safety check operation.

A work machine locking device according to the present invention includes operating devices for inputting actuation commands to a work machine, a lock commanding means adapted to command locking for halting the work machine or unlocking for enabling the work machine to resume working, an electronic circuit adapted to compute the method of locking said work machine based on signals that have been input from the operating devices and the lock commanding means, and a lock executing means adapted to be controlled by signals output from said electronic circuit so as to maintain or release the work machine at or from the locked state.

As described above, the lock executing means is controlled by signals that have been output from said electronic circuit based on signals input from the operating devices and the lock commanding means. Therefore, locking and unlocking of the work machine can easily be controlled according to signals input from the operating devices and the lock commanding means. For example, in case the operator commands to release the work machine from the locked state in the situation where there is an outstanding actuation command from an operating device, the work machine is maintained locked by the lock executing means, which is controlled based on arithmetic signals from the electronic circuit. In case there is no actuation command from the operating devices, the lock commanding means commands locking and then commands unlocking so that the lock by the lock executing means is released, thereby enabling the actuation of the work machine.

According to another feature of the invention, the aforementioned lock executing means is an electromagnetic selector valve intended for locking the hydraulic system and disposed in a pilot oil feeding line that is adapted to feed pilot pressure to a control valve in a hydraulic circuit, which is adapted to control operation of the work machine. Said electromagnetic selector valve is hereinafter called a hydraulic system locking electromagnetic selector valve.

As described above, the lock executing means consists of a hydraulic system locking electromagnetic selector valve disposed in a pilot oil feeding line that is adapted to feed pilot pressure to a control valve in a hydraulic circuit. Therefore, by controlling the pilot oil pressure by means of the hydraulic system locking electromagnetic selector valve so as to lock the control valve at the neutral position, the work machine can be locked easily and reliably. For example, even if the operator commands to release the work machine from the locked state in the situation where there is an outstanding actuation command from an operating device, the electronic circuit closes the pilot oil feeding line by using the hydraulic system locking electromagnetic selector valve so as to maintain the control valve at the neutral position and, consequently, maintains the work machine at the locked state. In case unlocking of the work machine is commanded after a locking command is sent by the lock commanding means when there is no actuation command from the operating devices, the electronic circuit opens the pilot oil feeding line by opening the hydraulic system locking electromagnetic selector valve so that the control valve is controlled by the pilot oil pressure.

DETAILED DESCRIPTION OF THE PREFERRED EMBODIMENT

Figure 1:
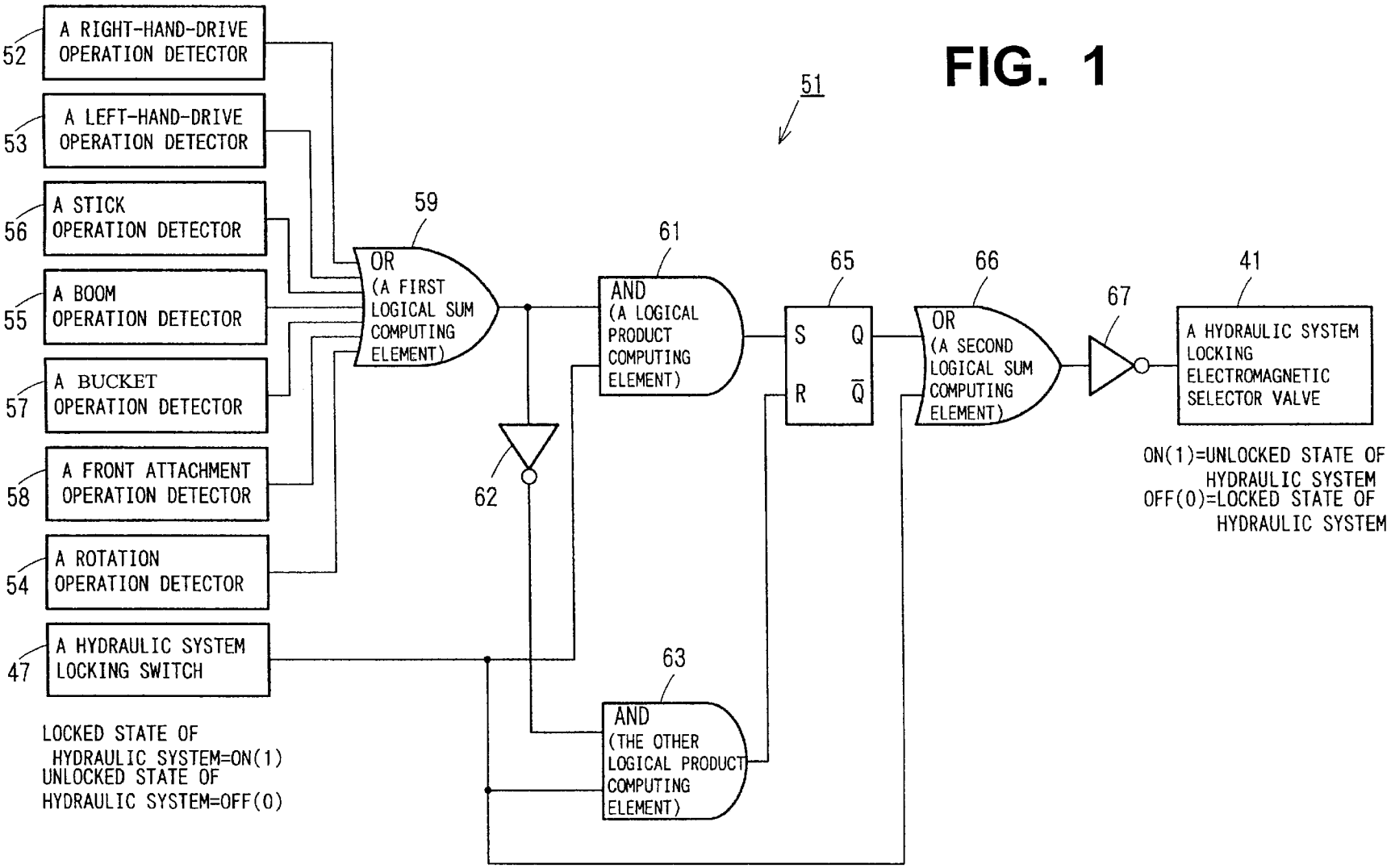
FIG. 1 is a circuit diagram of an embodiment of a logic circuit concerning the method of locking a work machine according to the present invention.
Figure 2:
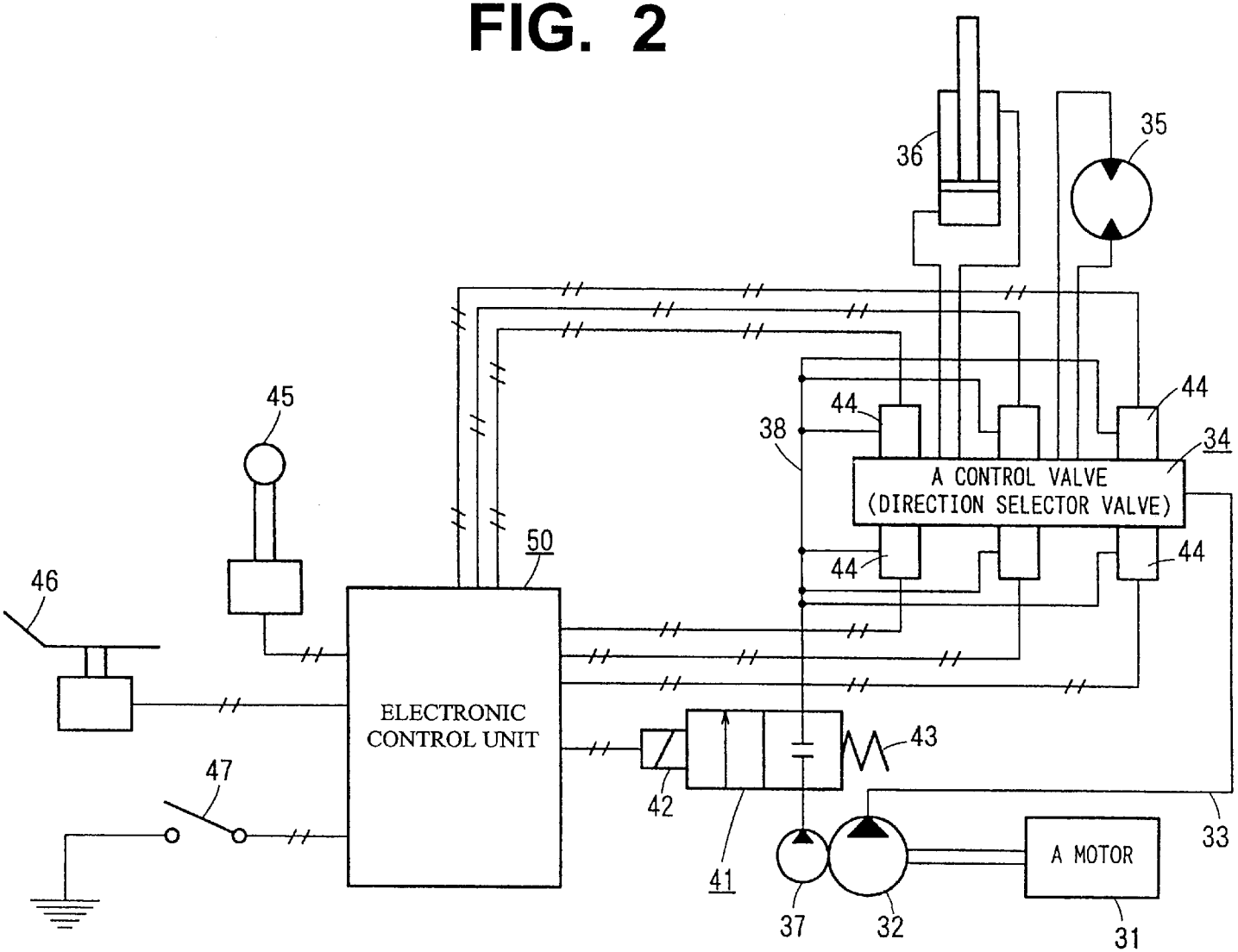
FIG. 2 is a circuit diagram showing an electric circuit and a hydraulic circuit concerning a work machine locking device according to the present invention.

Next, an embodiment of the present invention is explained hereunder, referring to FIGS. 1 through 3. When a need arises to refer to a hydraulic shovel as a work machine in the explanation hereunder, reference is made to the hydraulic shovel shown in FIG. 4.

As shown in FIG. 2, the hydraulic system comprises a working fluid feeding line 33 and a control valve 34. The working fluid feeding line 33 is connected to the discharge opening of a main pump 32 adapted to be driven by a motor 31, which may be an on-vehicle engine or the like, while a feeding port of the control valve 34 is connected to the working fluid feeding line 33.

The control valve 34 is provided, in its valve body, with movable valve elements, such as stems, for controlling the directions and the flow rates of the working fluid fed to the hydraulic actuators. The number of movable valve element disposed in the control valve 34 corresponds to the number of the hydraulic actuators. Rotary-type hydraulic actuators 35 comprise travel motors 11, which are disposed at both lateral sides of the work machine, and a swing motor 14. Longitudinal-motion hydraulic actuators 36 comprise a boom cylinder 25, a stick cylinder 26 and a bucket cylinder 27. These rotary-type hydraulic actuators 35 and longitudinal-motion hydraulic actuators 36 are connected to the output port of the control valve 34. The explanation of the tank, including returning from the control valve 34 to the tank, is omitted herein.

A pilot oil feeding line 38 is connected to the discharge opening of a pilot pump 37, which is adapted to be driven by the motor 31 together with the main pump 32. A hydraulic system locking electromagnetic selector valve (solenoid operated directional control valve) 41 that serves as a locking means is disposed in the pilot oil feeding line 38.

The hydraulic system locking electromagnetic selector valve 41 is adapted to lock or unlock the movable valve elements of the aforementioned control valve 34, which serves to control operation of the various hydraulic actuators 35,36 of the hydraulic shovel. To be more specific, the hydraulic system locking electromagnetic selector valve 41 locks said movable valve elements at the neutral position by means of the pilot hydraulic system or releases the lock of the movable valve elements. Thus, the various working portions of the hydraulic shovel will be forcibly halted and maintained at the locked state, or released from the locked state.

The hydraulic system locking electromagnetic selector valve 41 is a solenoid operated 2-port, 2-position directional control valve and has a solenoid portion 42 at one side of the movable valve element, which may be a spool, and a return spring 43 at the other side of the movable valve element. When the hydraulic system locking electromagnetic selector valve 41 is returned to the return position shown in FIG. 2 by its return spring 43, the hydraulic system locking electromagnetic selector valve 41 intercepts the supply of the pilot oil pressure that serves to pilot-operate the aforementioned movable valve elements in the control valve 34. As the interception of the supply of the pilot oil pressure by the hydraulic system locking electromagnetic selector valve 41 maintains the movable valve elements in the control valve 34 at their respective neutral positions, the hydraulic pressure is maintained at the locked state so that the hydraulic actuators 35,36 are halted. When the solenoid portion 42 is energized with electric current, the selector valve 41 is switched to link the pilot pump 37 with the pilot oil feeding line 38 so that the hydraulic system is released from the locked state.

The pilot oil feeding line 38, which extends via the hydraulic system locking electromagnetic selector valve 41, is connected to a plurality of electro-hydraulic transducing valves 44 that are adapted to pilot-operate the movable valve elements disposed in the control valve 34. The movable valve elements in the control valve 34 respectively correspond to the various hydraulic actuators 35,36.

Each electro-hydraulic transducing valve 44 has a solenoid portion and a movable valve element. Based on electric signals fed to the solenoid portion, the movable valve element of each electro-hydraulic transducing valve 44 controls the source pilot pressure that has been fed to the movable valve element from the pilot pump 37 through the hydraulic system locking electromagnetic selector valve 41. Thus, each electro-hydraulic transducing valve 44 pilot-operates the corresponding movable valve element in the control valve 34.

As shown in FIG. 2, the electric system includes electric operation levers 45, electric operation pedals 46 and a hydraulic system locking switch 47, all of which are connected to input terminals of an electronic control unit 50. The electric operation levers 45 that may be electric joy sticks or the like and serve as operating devices for controlling such hydraulic actuators as the swing motor 14, the boom cylinder 25, the stick cylinder 26 and the bucket cylinder 27. The electric operation pedals 46 serve as operating devices for controlling such hydraulic actuators as the left and right travel motors 11 and the front attachment 29. The hydraulic system locking switch 47 serves as a lock commanding means for maintaining the movable valve elements in the control valve 34 at their respective neutral positions by intercepting the supply of the hydraulic pilot pressure to the movable valve elements in the control valve 34.

The electric operation levers 45 and the electric operation pedals 46 mentioned above are operating devices adapted to input actuation commands to a hydraulic shovel, which serves as a work machine. Each one of the electric operation levers 45 and the electric operation pedals 46 is designed such that its automatic return to the neutral position prevents input of an actuation command.

The hydraulic system locking switch 47 is a lock commanding means that is adapted to halt the actuating portions of the work machine, e.g. the hydraulic shovel, by commanding to lock the hydraulic pressure in response to switching on, i.e. closing the contacts, performed by the operator, and bring the actuating portions of the hydraulic shovel by releasing the lock of the hydraulic pressure in response to switching off, i.e. opening the contacts, performed by the operator.

The solenoid portion 42 of the aforementioned hydraulic system locking electromagnetic selector valve 41 and the solenoid portions of the electro-hydraulic transducing valves 44 are connected to the output terminals of the electronic control unit 50.

The aforementioned electronic control unit 50 is provided with a logic circuit 51, which is a digital electronic circuit shown in FIG. 1. The logic circuit 51 is a digital circuit adapted to compute signals to be output to the solenoid portion 42 of the hydraulic system locking electromagnetic selector valve 41. The logic circuit performs said computation based on signals input from one or a number of the electric operation levers 45, the electric operation pedals 46 and the hydraulic system locking switch 47 and has a configuration described as follows.

Referring to FIG. 1, a right-hand-drive operation detector 52, a left-hand-drive operation detector 53, a rotation operation detector 54, a boom operation detector 55, a stick operation detector 56, a bucket operation detector 57 and a front attachment operation detector 58 are connected to the input section of a first logical sum computing element 59. These detectors 52 through 58 are adapted to detect signals representing various operation performed by means of the aforementioned electric operation levers 45 and electric operation pedals 46.

The output section of the first logical sum computing element 59 is connected to an input section of one of the logical product computing elements, i.e. the logical product computing element 61, and also connected through a NOT operation element 62 to an input section of the other logical product computing element 63.

The aforementioned hydraulic system locking switch 47 is connected to the other input section of said other logical product computing element 63.

The output section of the logical product computing element 61 and the output section of the logical product computing element 63 are respectively connected to the input sections S,R of a flip-flop computing element 65 of a set-reset type.

One of the output sections (the output section Q) of the set-reset type flip-flop computing element 65 is connected to one of the input sections of a second logical sum computing element 66. The other input section of the second logical sum computing element 66 is connected to the aforementioned hydraulic system locking switch 47.

The output section of the second logical sum computing element 66 is connected through a NOT operation element 67 to the solenoid portion 42 of the aforementioned hydraulic system locking electromagnetic selector valve 41.

The truth table of the set-reset type flip-flop computing element 65 is represented in Table 1.

TABLE 1

(Truth Table)

| S | R | Qn + 1 |
|---|---|---|
| 0 | 0 | Qn |
| 0 | 1 | 0 |
| 1 | 0 | 1 |
| 1 | 1 | Undefined |

Qn: the state before adding a signal to R or S
Qn + 1: the state after adding a signal to R or S When commanding locking of the hydraulic system, the hydraulic system locking switch 47 should be switched on so as to output "1". When commanding unlocking of the hydraulic system, the switch 47 should be switched off so as to output "0".

As for the function of the hydraulic system locking electromagnetic selector valve 41, an "on" signal ("1") from the NOT operation element 67 excites the solenoid portion 42 of the hydraulic system locking electromagnetic selector valve 41 so that the hydraulic system locking electromagnetic selector valve 41 is switched to release the hydraulic system from the locked state by connecting the pilot oil feeding line 38, and an "off" signal ("0") from the NOT operation element 67 causes the return spring to return the hydraulic system locking electromagnetic selector valve 41 to the return position so that the hydraulic system locking electromagnetic selector valve 41 locks the hydraulic system by intercepting the pilot oil feeding line 38.

Figure 3A:
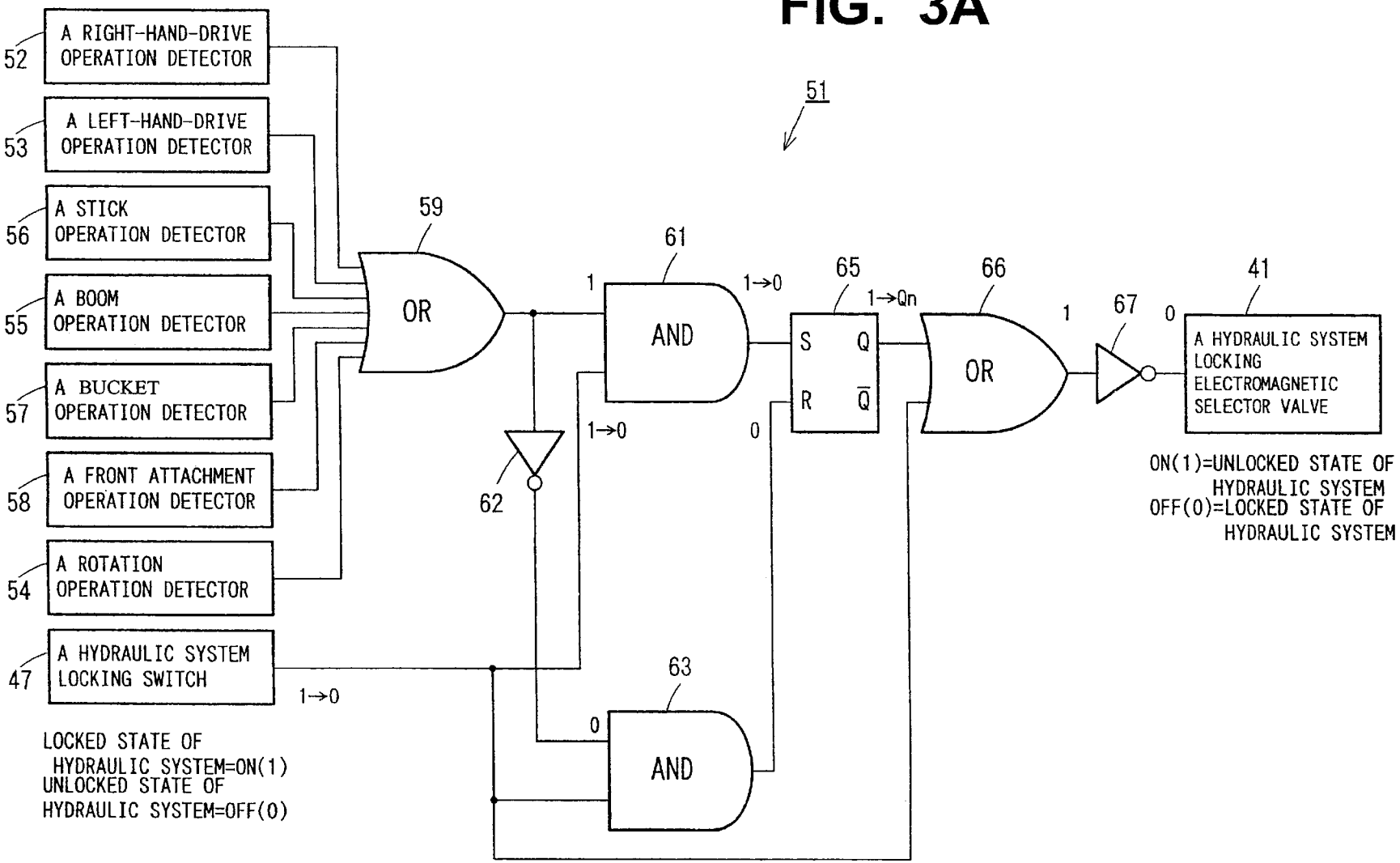
FIG. 3(A) is a circuit diagram explaining how the logic circuit shown in FIG. 1 initiates locking of the hydraulic system.
Figure 4:
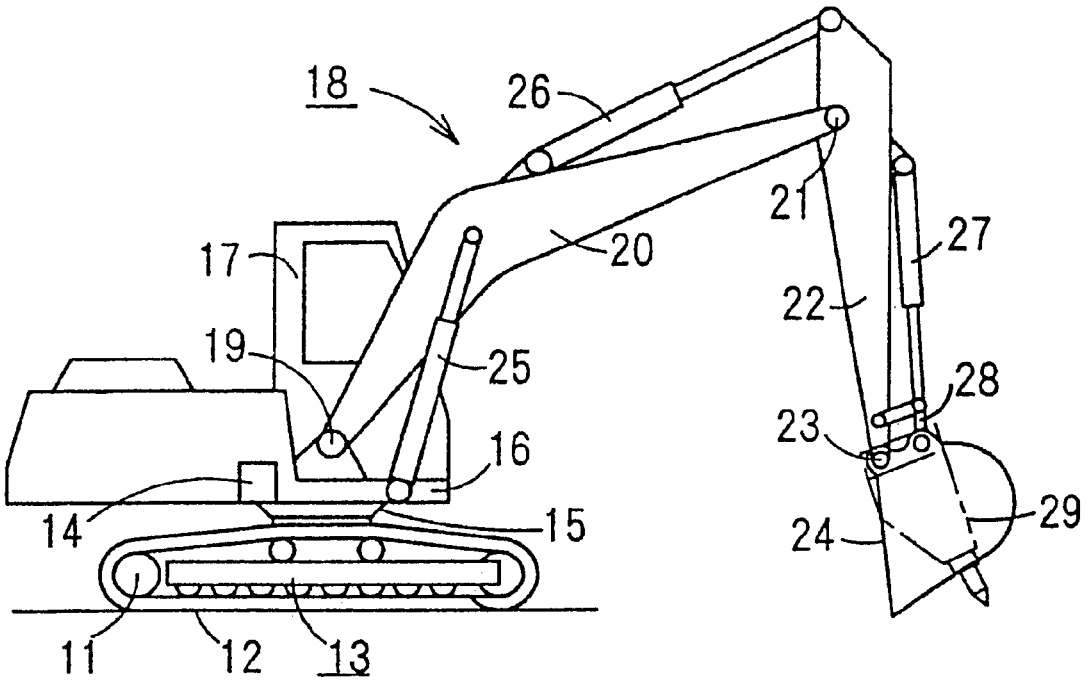
FIG. 4 is a schematic illustration of a hydraulic shovel.

Next, the function of the embodiment shown in FIGS. 1 and 2 is explained, referring to FIGS. 3(A), (B) and (C). In the following explanation, (A), (B) and (C) refer to FIGS. 3(A), (B) and (C), respectively.

(A) When one or a number of the operation levers 45 and the operation pedals 46 have been operated and are at non-neutral positions, in other words when a signal or signals representing its or their operation have been detected by the corresponding detectors 52 through 58, the signal output from the first logical sum computing element 59 is "1".

If the hydraulic system locking switch 47 is at the hydraulic system locking position, in other words at the "on" state (at the position "1") in such a situation as described above, the signal output from the logical product computing element 61 is "1", while the signal output from the other logical product computing element (the element 63) is "0". Therefore, the output section Q of the set-reset type flip-flop computing element 65 outputs a signal "1". After going through the second logical sum computing element 66, said signal is changed to "0" by the NOT operation element 67 so that the hydraulic system locking electromagnetic selector valve 41 is changed over to the hydraulic system locking position, where it intercepts the pilot oil feeding line 38.

Therefore, even if the electronic control unit 50 outputs to the solenoid portions of the electro-hydraulic transducing valves 44 the operating signals that correspond to the degree of operation of the operation lever(s) 45 or the operation pedal(s) 46, no pilot source pressure is fed to the electro-hydraulic transducing valves 44, and, accordingly, all the movable valve elements of the control valve 34 are held at their neutral positions by incorporated springs and do not output the working fluid to the hydraulic actuators 35,36.

In such a situation, even if the operator carelessly or otherwise operates the hydraulic system locking switch 47 so as to release the hydraulic system from the locked state, in other words if the output from the hydraulic system locking switch 47 is switched from "1" to "0", the output change (from "1" to "0") of the logical product computing element 61 and the state of output of the logical product computing element 63, which remains at "0", merely change the output section Q of the set-reset type flip-flop computing element 65 from the aforementioned signal "1" to the signal "Qn", which keeps said signal "1" unchanged. As a result, the work machine continues to be locked so that its operation is held at a stand still.

As described above, even if the operator accidentally switches the hydraulic system locking switch 47 to the hydraulic system unlocking position during the period where one or a number of the operation levers 45 and the operation pedals 46 is in the operated state, the safety mechanism functions so as to ensure the safety by maintaining the hydraulic system locked.

(B) Once the safety mechanism is actuated as described above to prevent unlocking of the hydraulic system after the hydraulic system locking switch 47 has output a signal "0", i.e. a signal for releasing the hydraulic system from the locked state, the signals output from the two logical product computing elements 61,63 are both "0" even if all the operation levers 45 and operation pedals 46 are returned to the neutral positions so as to make the output from the first logical sum computing element 51 "0". Therefore, the output section Q of the set-reset type flip-flop computing element 65 merely outputs the signal "Qn" for maintaining the hydraulic system at the locked state. As the safety mechanism thus continues to work, there is no possibility of the hydraulic system being undesirably unlocked.

This is to ensure that, until the operator performs a particular operation for ascertaining the safety of the situation, the hydraulic system cannot be unlocked merely by returning the operation levers 45 and the operation pedals 46 to the non-operating, neutral positions.

(C) When halting the safety mechanism and releasing the lock of the hydraulic system, safety check is performed while the output from the first logical sum computing element 59 is maintained at "0" by holding the operation levers 45 and the operation pedals 46 at the neutral positions. To do so, the hydraulic system locking switch 47 is switched once to the hydraulic system locking position in this state, and is then returned to the hydraulic system unlocking position so that the output from the hydraulic system locking switch 47 is switched once to "1" and then to "0".

In response to the above operation, the output signal from the logical product computing element 63 changes to "1" and then changes again to "0" while the output signal from the logical product computing element 61 remains at "0". Therefore, after the signal "0" for releasing the lock of hydraulic system is output from the output section Q of the set-reset type flip-flop computing element 65, the signal "Qn" intended for maintaining the system at the unlocked state is output.

As the change in output from the hydraulic system locking switch 47, i.e. the change from "1" to "0", is input to the second logical sum computing element 66 together with the signal "0" output from the flip-flop computing element 65, the signal output from the second logical sum computing element 66 changes from "1" to "0", and the signal is then changed from "0" to "1" by the NOT operation element 67. As a result of the change in output signals from the NOT operation element 67, the hydraulic system locking electromagnetic selector valve 41 is changed over from locking the hydraulic system to releasing the lock of the hydraulic system and connects the pilot oil feeding line 38. In other words, the signal "1" from the NOT operation element 67 excites the solenoid portion 42 of the hydraulic system locking electromagnetic selector valve 41 so that the hydraulic system locking electromagnetic selector valve 41 connects the pilot oil feeding line 38, thereby releasing the hydraulic system from the locked state and stops the operation of the safety mechanism.

When the hydraulic system locking switch 47 is operated to the locking position, the second logical sum computing element 66 for receiving signals from the hydraulic system locking switch 47 is ensured to receive a locking signal "1" and output a signal "1" of its own so as to cause the NOT operation element 67 to reliably output a hydraulic system locking signal "0". The second logical sum computing element 66 thus serves as a device that preferentially performs locking of hydraulic system when locking is commanded.

Figure 3B:
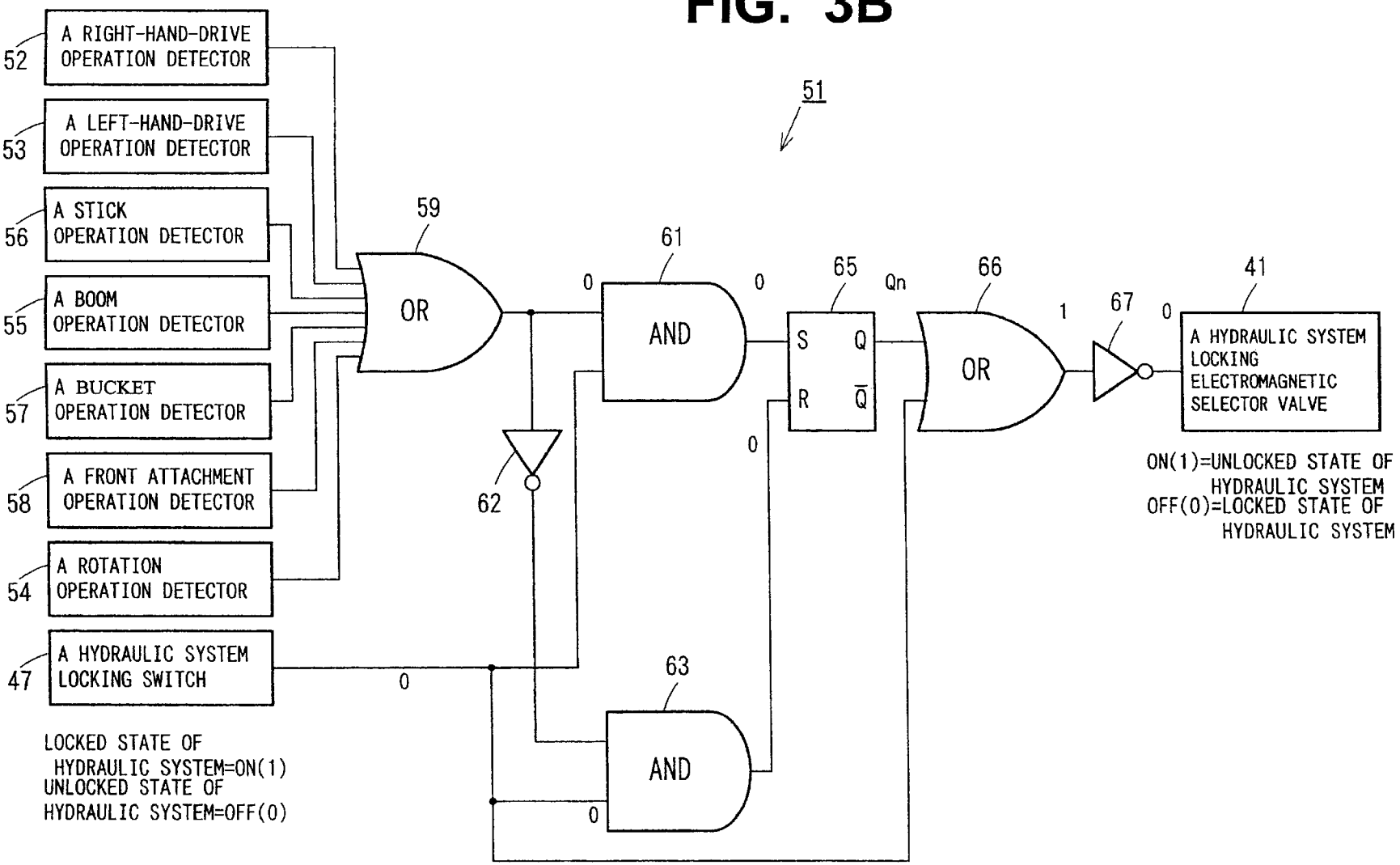
FIG. 3(B) is a circuit diagram explaining how said logic circuit maintains the locking of the hydraulic system.
Figure 3C:
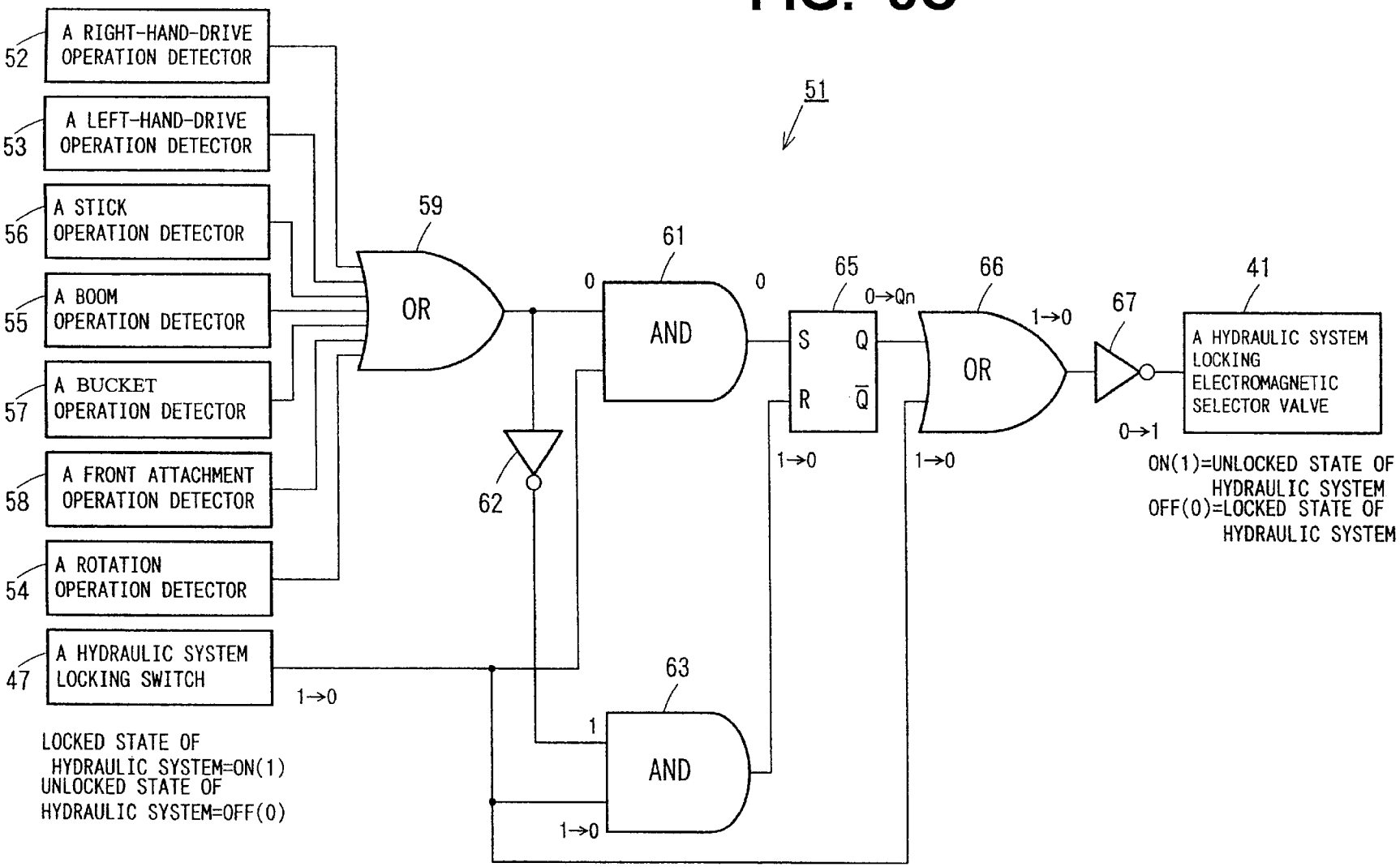
FIG. 3(C) is a circuit diagram explaining how said logic circuit releases the hydraulic system from the locked state.

As described above, once the safety mechanism is actuated, the lock of the hydraulic system will never be released regardless of whether all the operation levers 45 and operation pedals 46 are at the neutral positions; the only way to release the lock is to make sure it is safe to release the lock by switching the hydraulic system locking switch 47 to the hydraulic system locking position as shown in FIG. 3(C) and, thereafter, shift the switch again to the hydraulic system unlocking position.

In other words, merely returning the operation levers 45 and the operation pedals 46 to the neutral positions in the hydraulic system unlocking state as shown in FIG. 3(B) does not release the hydraulic system from the locked state, because the safety mechanism is still working.

In case the hydraulic system locking switch 47 is already in the hydraulic system locking mode when all the operation levers 45 and operation pedals 46 are at the neutral positions, it means that the safety mechanism is already functioning. Therefore, in the same manner as with a conventional device, the operator is able to release the hydraulic system from the locked state by switching the hydraulic system locking switch 47 to the hydraulic system unlocking position. This, too, is as shown in FIG. 3(C).

As described above, in case a signal representing a command of actuating a hydraulic actuator of a work machine equipped with an electronic control system and a hydraulic system is detected before releasing the hydraulic system from the locked state, the invention ensures the safety by preventing release of the hydraulic system even if the operator tries to release the hydraulic system from the locked state. Furthermore, even if all the operation levers 45 and operation pedals 46 are at the neutral positions, in order to ensure the safety, it is absolutely imperative as a prerequisite for unlocking the hydraulic system that the hydraulic system is at the locked state or hydraulic system locking operation is performed.

It is to be understood that the embodiment explained above is merely an example of the logic to put the present invention in practical use and that the scope of the invention is not limed to the hardware and/or the software shown in the attached drawings; any other appropriate hardware or software may be used.

POSSIBLE INDUSTRIAL APPLICATION

As described above, a locking method and/or a locking device according to the invention can be applicable to a wide range of examples of work machines that necessitate forcible halting. The invention is particularly suitable for a construction machine, such as a hydraulic shovel.

What is claimed is:

1. A method of locking a work machine, wherein, once the work machine becomes locked so that its operation is forcibly halted, the work machine is maintained locked until a safety check is performed wherein the work machine is released from a locked state by commanding locking in a state where there is no outstanding actuation command input to the work machine and, thereafter, commanding release of the lock of the work machine.

2. The method of locking a work machine as claimed in claim 1, wherein, in case unlocking of the work machine is commanded where there is an outstanding actuation command input to the work machine, the work machine is maintained locked until a safety check is performed.

3. The method of locking a work machine as claimed in claim 1, wherein the work machine is maintained locked, when there is an outstanding command for unlocking the work machine while there is no outstanding actuation command input to the work machine.

4. A work machine locking device including:

operating devices for inputting actuation commands to the work machine;

a lock commanding means adapted to command locking in order to halt the work machine or unlocking in order to enable the work machine to resume working;

an electronic circuit adapted to compute a work machine locking method as claimed in any one of the claims from claim 1, said electronic circuit performing said computation based on signals that have been input from the operating devices and the lock commanding means; and a lock executing means adapted to be controlled by signals output from said electronic circuit so as to maintain or release the work machine at or from the locked state.

5. A work machine locking device as claimed in claim 4, wherein said lock executing means is an electromagnetic selector valve intended for locking a hydraulic system and disposed in a pilot oil feeding line that is adapted to feed pilot pressure to a control valve in a hydraulic circuit, which is adapted to control operation of the work machine.

* * * * *